United States Patent [19]

Kano et al.

[11] Patent Number: 4,860,056

[45] Date of Patent: Aug. 22, 1989

[54] SEALABLE TONER RECOVERY BOX FOR AN IMAGE FORMING MACHINE

[75] Inventors: Atsushi Kano, Amagasaki; Yasuyuki Ishiguro; Tadakazu Ogiri, both of Osaka; Hirofumi Ozaki, Sakai; Yuji Yamashita, Matsudo, all of Japan

[73] Assignee: Mita Industrial Co., Ltd., Osaka, Japan

[21] Appl. No.: 122,097

[22] Filed: Nov. 17, 1987

[30] Foreign Application Priority Data

Nov. 29, 1986 [JP] Japan ..... 61-283163
Nov. 29, 1986 [JP] Japan ..... 61-283164

[51] Int. Cl.[4] ..... G03G 15/06; G03G 15/00; G03G 21/00

[52] U.S. Cl. ..... 355/298; 118/652

[58] Field of Search ..... 355/15, 3 DD, 3 DR, 355/3 R; 118/652; 430/125; 222/DIG. 1; 15/256.5–256.53

[56] References Cited

U.S. PATENT DOCUMENTS 3,539,077 11/1970 Drexler et al. ..... 222/DIG. 1 X
3,819,263 6/1974 Draugelis et al. .
4,062,385 12/1977 Katusha et al. ..... 222/DIG. 1 X
4,251,155 2/1981 Schnall et al. ..... 355/15
4,281,918 8/1981 Fortmann ..... 355/3 DD X
4,618,250 10/1986 Noguchi et al. .
4,730,205 3/1988 Ogiri et al. ..... 355/15

FOREIGN PATENT DOCUMENTS 0217173 4/1987 European Pat. Off. .
142377 8/1983 Japan .
179886 10/1983 Japan ..... 355/15
21071 2/1985 Japan .
170882 4/1985 Japan .
239777 11/1985 Japan ..... 355/3 DD
20068 1/1986 Japan ..... 355/3 DD

*Primary Examiner*—Arthur T. Grimley
*Assistant Examiner*—Edward Pipala
*Attorney, Agent, or Firm*—Antonelli, Terry & Wands

[57] ABSTRACT

A cleaning device in an image-forming machine. A supporting frame structure includes a toner recovery box receiving space and a toner recovery box to be inserted into the receiving space. A toner inlet extending in the front-rear direction is formed in the toner recovery box. The cleaning device further includes a cover for recovering or closing the toner inlet at the time of withdrawing the toner recovery box from the receiving space, thereby preventing scattering of toner from the toner inlet.

8 Claims, 10 Drawing Sheets

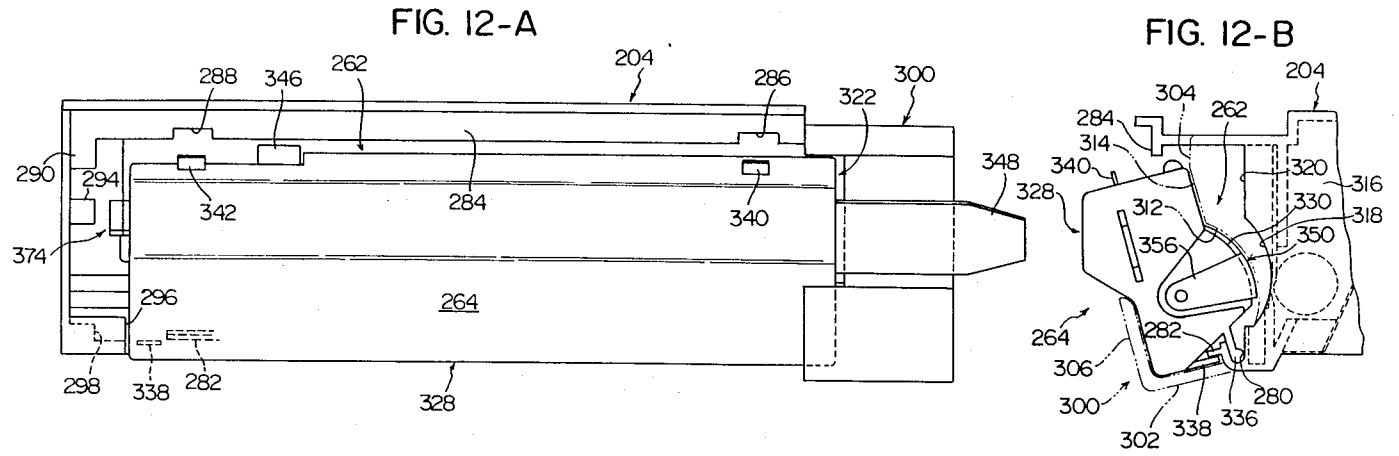
FIG. 12-B
FIG. 12-A
204
262
304
284
314
340
328
316
318
320
330
350
312
356
282
280
336
338
302
306
300
264
348
322
286
346
288
342
294
290
374
296
298
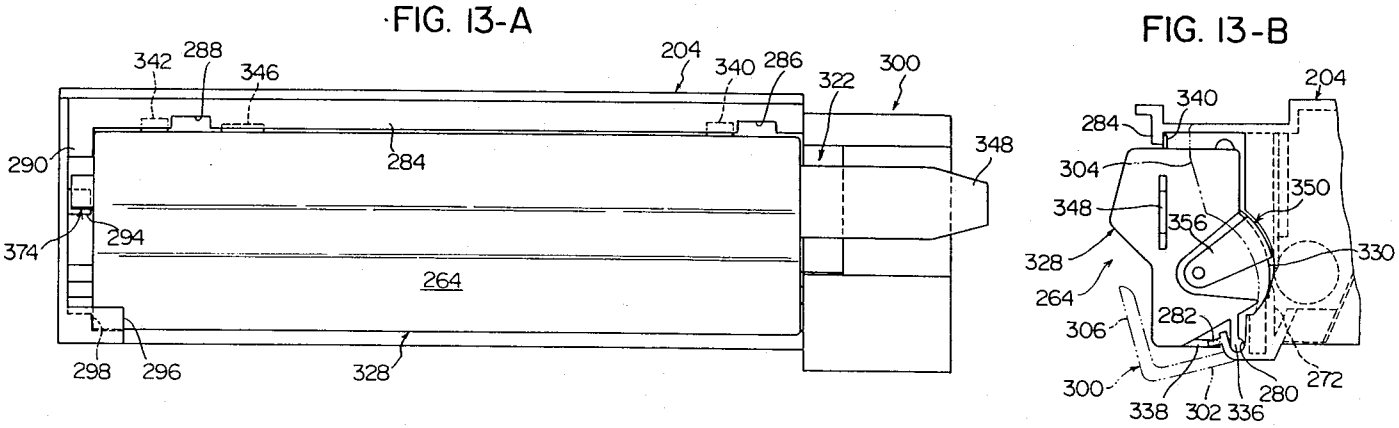
FIG. 13-B
FIG. 13-A
204
340
284
304
348
328
264
306
300
330
350
272
280
336
302
338
356
282
348
300
322
286
340
204
284
264
328
346
288
342
294
290
374
296
298

FIG. 12-C
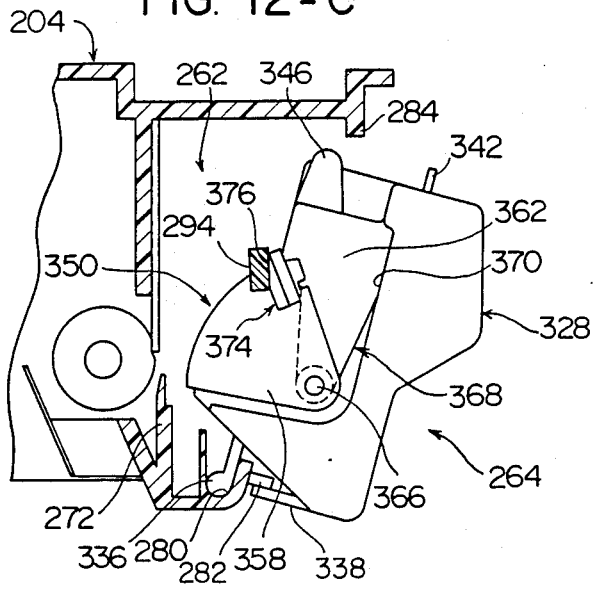
FIG. 13-C
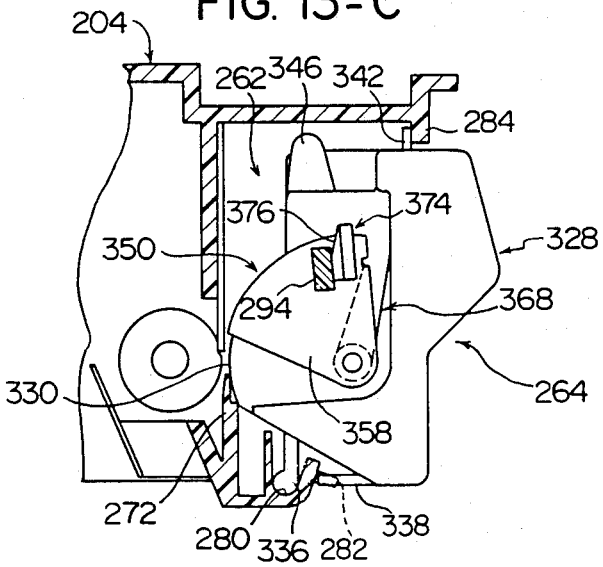

SEALABLE TONER RECOVERY BOX FOR AN IMAGE FORMING MACHINE

FIELD OF THE INVENTION

This invention relates to a cleaning device for removing residual toner from the surface of a photosensitive material in an image-forming machine such as an electrostatic copying machine.

DESCRIPTION OF THE PRIOR ART

In an image-forming machine such as an electrostatic copying machine, a latent electrostatic image is formed on the surface of a photosensitive material disposed on a rotating drum or an endless belt and then developed to a toner image. The toner image then transferred to a receptor sheet such as ordinary paper, and for the next cycle of image formation, the toner image remaining on the surface of the photosensitive material is removed. The cleaning device used to remove the residual toner from the surface of the photosensitive material should be provided with toner holding means for holding the removed toner, as well with means for removing the residual toner from the surface of the photosensitive material.

On the other hand, in a small-size and low-priced image-forming machine, it has been proposed to construct a rotating drum, having a photosensitive material disposed on its peripheral surface, and various elements positioned around it, such as a cleaning device, as a unit and to mount such a unit replaceably on the image-forming machine. Such a unit system has already gained commercial acceptance. In an image-forming machine of the unit type, if the toner holding capacity of the toner holding means in the cleaning device is made sufficiently large with respect to the effective life of the photosensitive material, it is possible to use the photosensitive material until the end of the effective life, and then to replace the whole unit with a new one and discard the old one. However, to increase the toner holding capacity of the toner holding means sufficiently necessarily results in a bulky cleaning device, and it is impossible to reduce the size of the unit and therefore, the size of the image-forming machine on which the unit is to be mounted.

Irrespective of whether the cleaning device is constructed as a unit with the rotating drum, etc., the size reduction of the image-forming machine desirably requires size reduction of the toner holding means in the cleaning device. However, when the size of the toner holding means is reduced, the toner holding capacity naturally decreases. In such a case, when the toner holding means has been filled up with toner, it is necessary to suspend the use of the image-forming machine and to recover the toner. To recover the toner conveniently in this case, it has previously been proposed to construct a detachable toner recovery box as the toner holding means, and to replace it with a new toner recovery box when it is filled with toner, and such toner holding means has already come into commercial use.

In the cleaning device provided in a small-sized and low-priced image-forming machine, it is desired to omit a relatively complex and expensive helical vane mechanism and the like for forwardly or rearwardly transferring the toner removed from the photosensitive member. It is important in this case to use a toner recovery box of a type having a toner inlet extending in the front-rear direction along the photosensitive material in order to recover the toner sufficiently uniformly throughout the toner recovery box. When a toner recovery box of such a type is used, the toner frequently scatters from the toner inlet, and contaminates the surrounding environment or the operator's hands and garment, etc., as or after the toner recovery box filled with the toner is removed from the cleaning device.

SUMMARY OF THE INVENTION

It is an object of this invention to provide a cleaning device of the type in which a toner recovery box having a toner inlet extending in the front-rear direction is replaceably mounted, in which scattering of the toner from the toner inlet can be prevented during or after taking out the toner recovery box from the cleaning device.

According to one aspect of this invention, there is provided a cleaning device in an image-forming machine, said cleaning device comprising

- a supporting frame structure including a toner recovery box receiving space having an open front surface and extending in the front-rear direction,
- a toner recovery box having a toner inlet extending in the front-rear direction, said box being adapted to be inserted into said receiving space by being moved rearwardly and to be withdrawn from said space by being moved forwardly,
- a receiving member provided in the front surface of the supporting frame structure and positioned in front of the receiving space, and
- a protective cover whose rear end portion is inserted in the receiving member, said cover receiving the toner recovery box withdrawn from the receiving space and covering the toner inlet.

In a preferred embodiment, the protective cover has provided therein restraining means for hampering detachment of the toner recovery box from the protective cover once the protective cover has received the toner recovery box. inlet of the recovery box is covered with the protective cover during or after withdrawing the toner recovery box filled with the toner from the receiving space. Hence, toner scattering of toner at the toner inlet can be prevented. The toner recovery box, withdrawn from the receiving space of the supporting frame structure and received by the protective cover, can be discarded together with the protective cover removed from the receiving member.

According to another aspect, there is provided a cleaning device in an image-forming machine, said cleaning device comprising a supporting frame structure including a toner recovery box receiving space extending in the front-rear derection and an actuating element, and a toner recovery box adapted to be withdrawably inserted into said receiving space, said recovery box comprising a box having a toner inlet extending in the front-rear direction, a cover member mounted on the box so as to be free to move between a closed position at which it closes the toner inlet and an open position at which it exposes the toner inlet, elastic means for elastically biasing the cover member to the closed position, and a non-actuating element provided in the cover member;

wherein the actuating element and the non-actuating element are constructed such that when the toner recovery box is inserted into the receiving space, the actuating element acts on the non-actuating element to move the cover member to the open position against the biasing force of the elastic means.

In a preferred embodiment, at least the front surface of the receiving space is open; the toner recovery box is inserted into the receiving space by being moved at least rearwardly and withdrawn from the receiving space by being moved at least forwardly; and the actuating element and the non-actuating element are constructed such that while the toner recovery box is moved rearwardly to a particular position, the actuating element does not act on the non-actuating element, but while the toner recovery box is moved rearwardly from the particular position to a final position, the actuating element acts on the non-actuating element. At the particular position, the toner inlet of the toner recovery box is surrounded all along with the supporting frame structure.

In the above cleaning device of the invention, when the toner recovery box is inserted into the receiving space of the supporting frame structure, the actuating element acts on the non-actuating element to bring the cover member to the open position and to expose the toner inlet of the box. Hence toner is transferred from the toner inlet to the inside of the box without any trouble. On the other hand, when the toner recovery box is withdrawn from the receiving space of the supporting structure after it has been filled with toner, the actuating element fails to act on the non-actuating element. As a result, the cover member is brought to the closed position by the biasing action of the elastic means, and the toner inlet of the box is closed, Accordingly, scattering of the toner from the toner inlet is prevented.

BRIEF DESCRIPTION OF THE DRAWINGS

FIGS. 12-A, 12-B and 12-C are respectively a side, a front and a sectional view which show the toner recovery box of the unit of FIG. 7 inserted into the toner recovery box receiving space to a particular position.

FIGS. 13-A, 13-B and 13-C are a side, a front and a sectional view which respectively show the toner recovery box of the unit of FIG. 7 inserted into the toner recovery box receiving space to a final position.

DETAILED DESCRIPTION OF THE PREFERRED EMBODIMENTS

With reference to the accompanying drawings preferred embodiments of the cleaning device constructed in accordance with this invention will be described in detail.

Figure 1:
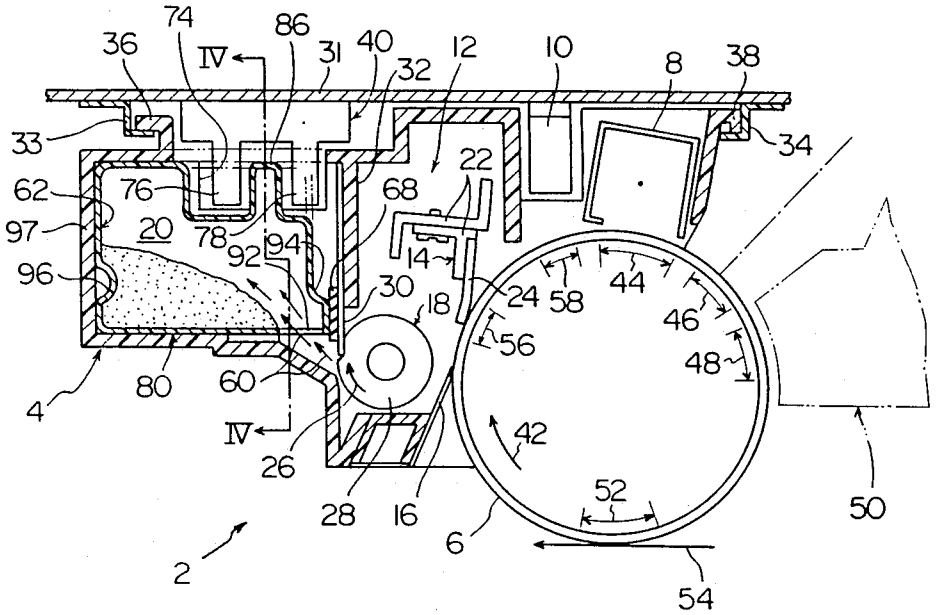
FIG. 1 is a sectional view showing a unit including a first embodiment of the cleaning device constructed in accordance with this invention.

FIG. 1 illustrates a unit including a first embodiment of the cleaning device constructed in accordance with this invention. The unit shown generally at 2 has a box-like supporting structure 4 having an open right side surface or under surface in FIG. 1. A rotating drum 6 having a suitable photosensitive material disposed on its peripheral surface is mounted on the supporting frame structure 4. Furthermore, a charging corona discharger 8 and a cleaning device generally shown at 12 are disposed on the supporting frame structure 4. The illustrated cleaning device 12 comprises removing means 14, sealing means 16, carry-in means 18 and toner holding means 20. The removing means 14 has a supporting member 22 mounted on the supporting frame structure 4 and an elastic blade 24 mounted on the supporting member 22. The free end portion, i.e. the lower end portion, of the blade 24 extending in the front-rear direction (i.e., in the direction perpendicular to the plane of the paper of FIG.1) is pressed against the peripheral surface of the rotating drum 6. The seal means 16 is formed of a flexible film extending in the front-rear direction. The lower end portion of this film is fixed to the supporting frame structure 4, and its upper end portion is kept in light contact with the peripheral surface of the rotating drum 6. The carry-in means 18 has a sponge roller 28, to be rotated in the direction shown by an arrow 26, and a separating plate 30. The separating plate 30 is fixed to a downwardly extending wall 32 formed integrally with the supporting frame structure 4. The lower end portion of the separating plate 30, which projects downwardly beyond the lower end of the downwardly extending wall 32, is pressed against the peripheral surface of the sponge roller 28. The toner holding means 20 will be described in detail hereinafter.

The unit 2 is detachably mounted within the housing of an image-forming machine such as an electrostatic copying machine. With reference to FIG. 1 again, a horizontally extending base plate 31 is disposed within the housing of the image-forming machine in the illustrated embodiment. A pair of horizontally spaced guide rails 33 and 34 extending in the front-rear direction are fixed to the under surface of the base plate 31. On the other hand, guided rails 36 and 38 extending in the front-rear direction are formed at the two side portions of the upper surface of the supporting frame structure 4 integrally. The unit 2 is mounted at a predetermined position within the housing by engaging the guided rails 36 and 38 of the supporting frame structure 4 with the guide rails 33 and 34 and sliding unit 2 rearwardly. The unit 2 is removed from the housing by sliding it forwardly. A charge eliminating lamp 10 and a toner detector 40 are also fixed to the under surface of the base plate 31 (The toner detector 40 will be described in detail hereinafter).

In the image-forming machine on which the unit has been mounted, the rotating drum 6 of the unit 2 is rotated in the direction shown by an arrow 42. In a charging zone 44, the peripheral surface of the rotating drum 6 is charged to a specific polarity by the charging corona discharger 8. Then, in an exposure zone 46, an image to be formed is projected onto the peripheral surface of the rotating drum by a suitable optical system (not shown). As a result, a latent electrostatic image is formed on the peripheral surface of the rotating drum 6. Thereafter, in a developing zone 48, the latent electrostatic image is developed to a toner image by a suitable developing device 50 shown by a two-dot chain line. The developing device 50 is disposed at a predetermined position within the housing. If desired, the developing device 50 may also be mounted on the supporting frame structure 4 of the unit 2. Then, in a transfer zone 52, a receptor sheet, which may be ordinary paper transferred in the direction shown by an arrow 54, is brought into intimate contact with the peripheral surface of the rotating drum 6, and by the action of transfer means (not shown) which may be a transfer corona discharger for applying a corona discharge to the back surface of the receptor sheet, the toner image on the peripheral surface of the rotating drum 6 is transferred to the receptor sheet. The receptor sheet having the toner image transferred thereto is peeled from the rotating drum 6 by suitable peeling means (not shown) and the toner image is fixed by suitable fixing means (not shown). Thereafter, the receptor sheet is discharged out of the housing. In the meantime, the rotating drum 6 continues to rotate, and in a cleaning zone 56, the toner remaining on the peripheral surface of the rotating drum 6, after the transfer, is removed by the blade 24 of the cleaning device 12. Furthermore, in a charge eliminating zone 58, light from the charge eliminating lamp 10 illuminates the peripheral surface of the rotating drum 6 to extinguish the residual charge. The toner removed from the peripheral surface of the rotating drum 6 in the cleaning zone 56 falls downwardly and is transferred in the direction shown by arrow 26 incident to the rotation of the sponge roller 28. By the separating plate 30, the toner is separated from the sponge roller 28 and carried into the toner holding means 20, as shown by arrow 60. Sealing means 16 prevents the toner from falling downwardly from the cleaning device 12.

The aforesaid structure and operation in the unit 2 and the image-forming machine on which it it mounted do not constitute any novel features of the invention. Hence, a detailed description of these is omitted in the present specification.

Figure 2:
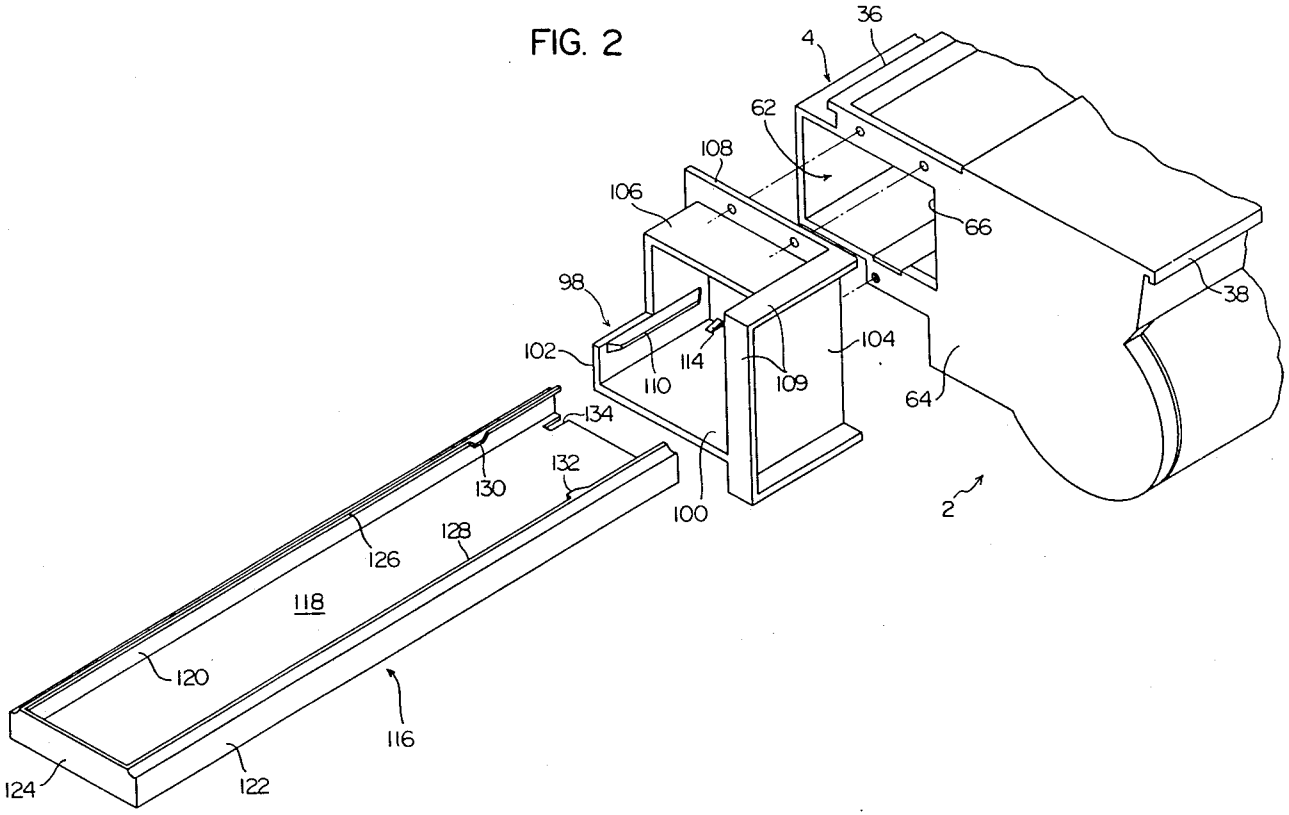
FIG. 2 is an exploded perspective view showing a toner recovery box receiving space, a receiving member and a protective cover in the cleaning device shown in FIG. 1.

With reference to FIGS. 1 and 2, a toner recovery box receiving space 62, having a nearly rectangular cross-sectional shape and extending in the front-rear direction, is formed in the left side portion (in FIG. 1) of the supporting frame structure 4 of the unit 2. As clearly shown in FIG. 2, an opening 66 corresponding to the above space 62 is formed in the front wall 64 of the supporting frame structure 4, and hence the front surface of the space 62 is open. As shown in FIG. 1, an elastic member 68, such as sponge extending in the front-rear direction, is fixed to the separating plate 30 defining the right side surface of the space 62. It will be seen by referring to FIG. 4 in conjunction with FIG. 1 that correspondingly to the rear end portion of the space 62, an opening 74 extending continuously from its upper wall 70 to its rear wall 72 is formed in the supporting frame structure 4. On the other hand, the toner detector 40, fixed to the under surface of the base plate 31 disposed in the housing of the image-forming machine, has two downwardly extending portions 76 and 78 projecting into the space 62 via the opening 74. In the downwardly extending portion 76, a suitable light emitting element (not shown) is disposed, and in the downwardly extending portion 78, a suitable light-receiving element (not shown,) for receiving light from the light-emitting element, is disposed.

Figure 3:
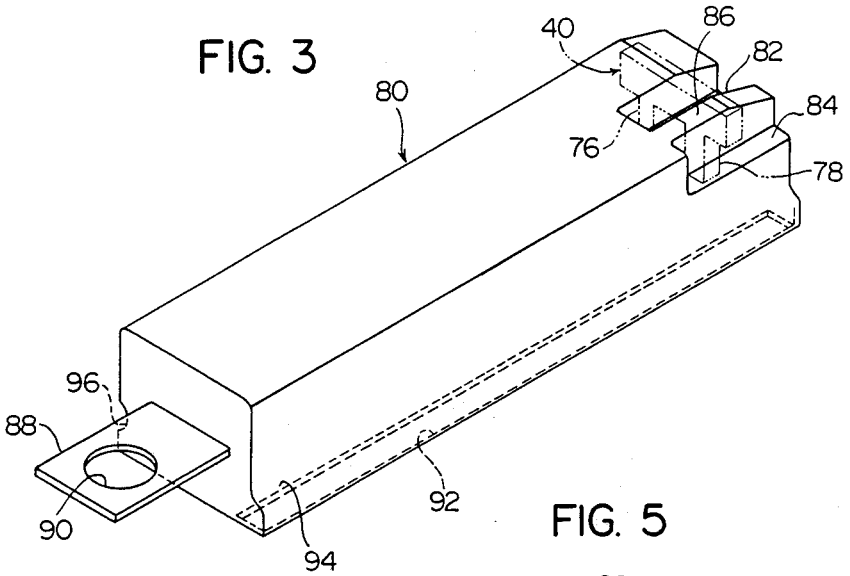
FIG. 3 is a perspective view showing a toner recovery box in the cleaning device shown in FIG. 1.

A toner recovery box 80 constituting the toner holding means 20 is received in the space 62 formed in the supporting frame structure 4. With reference to FIG. 3, the toner recovery box 80, preferably made of transparent to semitransparent synthetic resin, is of a shape nearly corresponding to the space 62, namely of a nearly rectangular parallelpipedal shape extending in the front-rear direction. Two depressed portions 82 and 84 are formed on the upper surface of the rear end portion of the toner recovery box 80. A detection portion 86 is defined between the depressed portions 82 and 84. A forwardly projecting gripping piece 88 is formed integrally of the front surface of the toner recovery box 80, and a circular opening 90, which can be held by a finger, is formed in the gripping piece 88. A toner inlet 92, preferably a rectangular opening extending in the front-rear direction, is formed in the right side portion of the under surface of the toner recovery box 80. It will be seen by referring to FIGS. 1 and 3 that the lower part of the right side surface of the toner recovery box 80 projects to the right, and a shoulder portion 94, extending in the front-rear direction and directed upwardly, is formed. In the left side surface of the toner recovery box 80, a depressed portion having a nearly semi-arcuate section is formed, and thus, a shoulder portion 96 extending in the front-rear direction and directed upwardly is formed.

Figure 4:
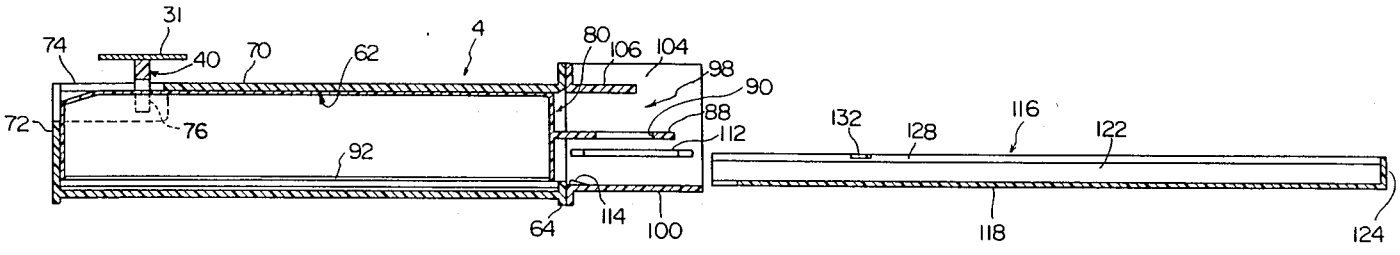
FIG. 4 is a sectional view taken along the line IV—IV of FIG. 1 showing a toner recovery box receiving space, a toner recovery box, a receiving member and a protective cover in the cleaning device shown in FIG. 1.

The toner recovery box 80 is inserted into, and received in, the space 62 by moving it rearwardly through the opening 66 formed in the front wall 64 of the supporting frame structure 4 until its rear surface abuts the rear wall 72 of the supporting frame structure 4 (namely, to the position shown in FIG. 4). As shown in FIG. 1, when the toner recovery box 80 is received in the space 62, the elastic member 68 is elastically compressed to bias the toner recovery box 80 elastically to the left and press it against the left side wall 97 of the supporting frame structure 4. As a result, the stability of the toner recovery box 80 within the space 62 is ensured. It will be seen by referring to FIGS. 1, 3 and 4 that when the toner recovery box 80 is received in the space 62, the downwardly extending portions 76 and 78 are positioned respectively in the depressed portions 82 and 84 of the toner recovery box 80 and the detection portion 86 of the toner recovery box 80 is positioned between the downwardly extending portions 76 and 78 of the toner detector 40. The gripping piece 88, provided on the front surface of the toner recovery box 80, projects forwardly from the space 62.

As operation of the image-forming machine on which the unit 2 is mounted is repeatedly performed, toner removed from the peripheral surface of the rotating drum 6 is carried into the toner recovery box 80 through the toner inlet 92, as shown by an arrow 60. When the toner recovery box 80 is nearly filled with toner, toner also exists in the detection portion 86 of the toner recovery box 80. As a result, light from the light emitting element (not shown) disposed in the downwardly extending portion 76 of the toner detector 40, is blocked by the toner, and the light-receiving element (not shown) disposed in the downwardly extending portion 78 of the toner detector 40, fails to receive light from the light-emitting element. On the basis of this, the toner detector 40 produces a signal showing that the toner recovery box 80 is filled with toner. In response to this, warning means (not shown) such as a warning lamp provided on the image-forming machine is energized, and as required, the image-forming machine is rendered inoperable.

When the toner recovery box 80 is filled up with toner, it is necessary to detach the toner recovery box 80 from the space 62 and insert a fresh toner recovery box 80 into the space 62. If, however, the toner recovery box 80 filled with toner is removed from the space 62 by simply moving it forwardly, toner comes out and scatters from the toner inlet 92 to contaminate the surrounding environment and the hands and garment of the operator.

Figure 5:
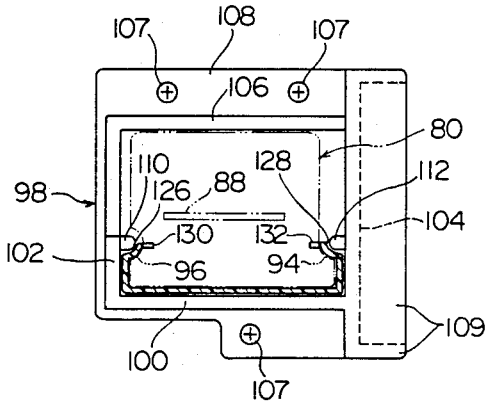
FIG. 5 is a sectional view showing the state in which a protective cover is inserted into a receiving member in the cleaning device shown in FIG. 1.

In the cleaning device 12 constructed in accordance with this invention, the following improvements are made. With reference to FIGS. 2 and 4, a receiving member 98, located forwardly of the space 62, is provided on the front surface of the supporting frame structure 4. The illustrated receiving member 98 has a bottom wall 100, two side walls 102 and 104 extending upwardly from the side edges of the bottom wall 100, an upper wall 106 existing only in the rear half part of the receiving member 98, a projecting wall 108 projecting outwardly from the upper wall 106, the left side wall 102 and the bottom wall 100 at the rear end of the receiving member 98, and a reinforcing projecting wall 109 formed in the right side wall 104 (see FIG. 5 also). The receiving member 98 is fixed to the supporting frame structure 4 by linking the projecting wall 108 to the front wall 64 of the supporting frame structure 4 by means of set screws 107 (FIG. 5). If desired, the receiving member 98 may be formed integrally with the supporting frame structure 4. It will be seen by referring to FIGS. 4 and 5 that a space having an open front surface and an open rear surface which is defined by the bottom wall 100, the two side walls 102 and 104 and the upper wall 106 of the receiving member 98 has a sectional shape only slightly larger in height and width than the space 62 of the supporting frame 4 and is positioned in alignment with the space 62 in the front-rear direction. As shown in FIGS. 2 and 5, protrusions 110 and 112, extending in the front-rear direction, are formed on the insides of the two side walls 102 and 104 of the receiving member 98. Furthermore, as shown in FIGS. 2 and 4, a wedge-shaped protruding portion 114 is formed in the rear end of the upper surface of the bottom wall 100.

In the cleaning device 12 constructed in accordance with this invention, a protective cover formed separately from the supporting frame structure 4 and the receiving member 98 is provided. With reference to FIG. 2, the illustrated protective cover 116 is a tray-like structure extending in an elongated shape in the front-rear direction, and has a nearly rectangular bottom wall 118 extending in an elongate shape in the front-rear direction, side walls 120 and 122 extending upwardly from the two side edges of the bottom wall 118, and a front wall 124 extending upwardly from the front end of the bottom wall 118. As FIG. 5 clearly shows, the side walls 120 and 122 of the protective cover 116 respectively have longitudinal protrusions 126 and 128 protruding inwardly from the upper ends thereof. As shown in FIG. 2, anchoring pieces 130 and 132 projecting further inwardly from the protruding edges of the longitudinal protrusions 126 and 128 are formed in the rear end portions of these longitudinal protrusions 126 and 128. Each of the anchoring pieces 130 and 132 is of a wedge-shape whose amount of inward projection increases progressively in the forward direction. As will be made clear from a description made hereinafter, the longitudinal protrusions 126 and 128 and the anchoring pieces 130 and 132 constitute restraining means which hampers removal of the toner recovery box 80 from the protective cover 116 once the toner recovery box 80 has been received in the protective cover 116. A notch 134, adapted to cooperate with the projecting portion 114 in the receiving member 98, is formed in the rear end of the bottom wall 118 of the protective cover 116.

Figure 6:
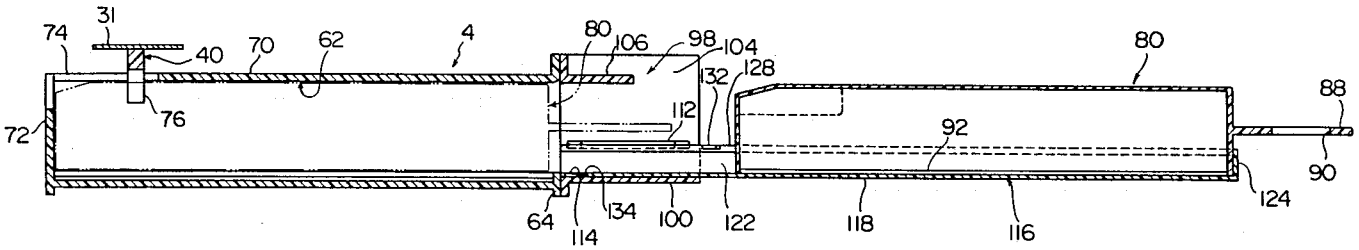
FIG. 6 is a sectional view, similar to FIG. 4, which shows the state wherein a protective cover is inserted into a receiving member and a toner recovery box is withdrawn onto a protective cover.

When the toner recovery box 80 is filled with toner, the rear end portion (the left end portion in FIG. 6) of the protective cover 116 is inserted into the receiving member 98, as shown in FIGS. 5 and 6, prior to withdrawing the toner recovery box 80 forwardly from the space 62 of the supporting frame structure 4. At this time, the bottom wall 118 of the protective cover 116 is contacted with the upper surface of the front wall 100 of the receiving member 98 to move the protective cover 116 rearwardly. As a result, the protrusions 110 and 112, formed in the inner surfaces of the side walls 102 and 104 of the receiving member 98, are positioned immediately above the side walls 120 and 122 of the protective cover 116, as shown in FIGS. 5 and 6. This restrains the upward movement of the rear end portion of the protective cover 116, and the protective cover 116 is held in the receiving member 98. When the protective cover 116 is inserted as far as a predetermined position, i.e. the position shown in FIG. 6, part (the left part in FIG. 6) of the rear end of the bottom wall 118 of the protective cover 116 abuts against the front wall 64 of the supporting frame structure 4, and the projecting portion 114, formed in the upper surface of the bottom wall 100 of the receiving member 98, is received in the notch 134 formed in the bottom wall 118 of the protective cover 116. It will be seen by referring to FIG. 6 as well as FIG. 1 that when the protective cover 116 is inserted in place into the receiving member 98, the upper surface of the bottom wall 118 of the protective cover 116 is positioned on substantially the same level as the bottom surface of the toner recovery box 80 received in the space 62 of the supporting frame structure 4, or slightly downwardly of it. Thereafter, the opening 90 of the gripping piece 88, formed on the front surface of the toner recovery box 80, is grasped by a finger, and the toner recovery box 80 is pulled forwardly (to the right in FIG. 6) to a position in which its front surface abuts against the front wall 124 of the protective cover 116, i.e. the position illustrated in FIG. 6. It will be understood by referring to FIG. 5 that at the time of this forward pulling, the shoulder portions 94 and 96 formed on both side surfaces of the toner recovery box 80 are guided respectively by the under surfaces of the longitudinal protrusions 126 and 128 formed in the side walls 120 and 122 of the protective cover 116, and therefore, the toner recovery box 80 is pulled out along the upper surface of the bottom wall 118 of the protective cover 116 without being displaced upwardly. The anchoring pieces 130 and 132 formed in the longitudinal protrusions 126 and 128 interfere with the two side surfaces of the toner recovery box 80. Since, however, the anchoring pieces 130 and 132 are of a wedge-shape whose amount of inward projection progressively increases forwardly, the two side walls 120 and 122 of the protective cover 116 are elastically deformed outwardly, and the toner recovery box 80 is elastically deformed inwardly. Hence, the toner recovery box 80 fully and smoothly goes past the anchoring pieces 130 and 132 and is pulled forwardly and received by the protective cover 116. As can be understood by referring to FIGS. 3 and 6, when the toner recovery box 80 is pulled out forwardly, toner inlet 92 formed in the bottom surface of the box 80 is gradually covered with the bottom wall 118 of the protective cover 116 as the toner recovery box 80 advances forward. Hence, the toner inlet 92 is not exposed, and dropping or scattering of toner from the toner inlet 92 can be prevented. After the toner recovery box 80 has been pulled out to the position shown in FIG. 6, it is possible to remove the protective cover 116 from the receiving member 98. by moving it cover 116 and box 80 forwardly, and to discard the protective cover 116 and the toner recovery box 80 received in it as an integral unit. In the state where the toner recovery box 80 is received in the protective cover 116, the longitudinal protrusions 126 and 128 of the protective cover 116 cooperate with the shoulder portions 94 and 96 formed in the two side surfaces of the toner recovery box 80 to hamper the upward movement of the toner recovery box 80 with respect to the protective cover 116 (see FIG. 5 also). In addition, by the interference of the anchoring pieces 130 and 132 in the protective cover 116 with the rear surface of the toner recovery box 80, the rearward (left in FIG. 6) movement of the toner recovery box 80 with respect to the protective cover 116 is also hampered. Consequently, accidental detachment of the toner recovery box 80 from the protective cover 116 at the time of discarding can be prevented, and therefore, dropping or scattering of toner from the toner inlet 92 can be prevented.

A fresh toner recovery box 80 can be inserted into the space 62 by moving it rearwardly through the receiving member 98. The bottom surface of the toner recovery box 80 is slightly elevated by the wedge-shaped projecting portion 114 formed in the rear end of the upper surface of the bottom wall 100 of the receiving member 98 to permit smooth insertion of the toner recovery box 80 into the space 62.

In the embodiment described above, the anchoring pieces 130 and 132 in the protective cover 116 are arranged in the protrusions 126 and 128 in the two side walls 120 and 122. If desired, one or a plurality of anchoring pieces may be disposed on the upper surface of the bottom wall 118, for example. Instead of the wedge-shaped anchoring pieces 130 and 132, anchoring pieces composed of elastic projecting pieces extending forwardly and inclined inwardly may be used.

The above embodiment uses the protective cover 116 in the form of a tray. It is also possible, where a toner inlet is formed, for example, on the upper portion of one side surface of the toner recovery box, to use a protective cover of a suitable form capable of covering the toner inlet, for example a cylindrical protective cover opened only at its rear surface for receiving the toner recovery box.

Figure 7:
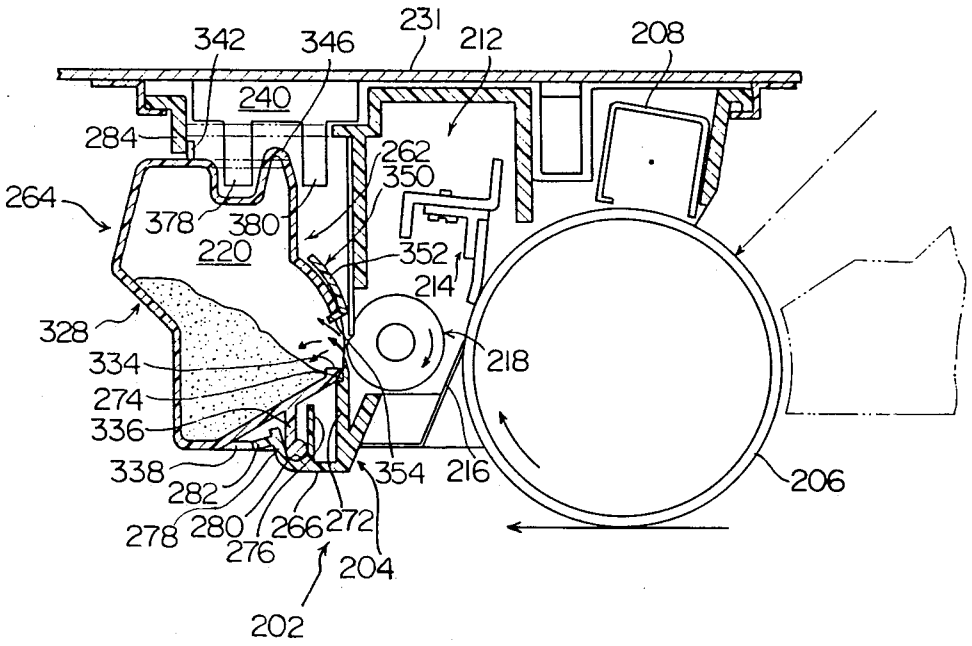
FIG. 7 is a sectional view showing a unit including a second embodiment of the cleaning device constructed in accordance with this invention.

FIG. 7 illustrates a unit containing a second embodiment of the cleaning device constructed in accordance with this invention. The unit, shown generally at 202, has a supporting frame structure 204 on which are mounted a cleaning device, shown generally at 212, together with a rotating drum 206 and a charging corona discharger 208. The cleaning device 212 comprises removing means 214, sealing means 216, carry-in means 218 and toner holding means 220. The unit 202 is substantially the same as the unit 2 shown in FIG. 1 except the toner holding means 220 and its related structures in the cleaning device 212. To avoid duplication, therefore, only the toner holding means 220 and its related structures in the cleaning device 212 in the unit 202 will be described in detail, and a description of the other structures and operations and the manner of mounting the unit 202 on the housing of an image-forming machine, such as an electrostatic copying machine will be omitted.

With reference to FIG. 7, a toner recovery box receiving space 262 extending in the front-rear direction (the direction perpendicular to the paper surface in FIG. 7) is formed in the left side portion in FIG. 7 of the supporting frame structure 204 of the unit 202. A toner recovery box shown generally at 264, which constitutes the toner holding means 220, is detachably inserted in the space 262.

Figure 8:
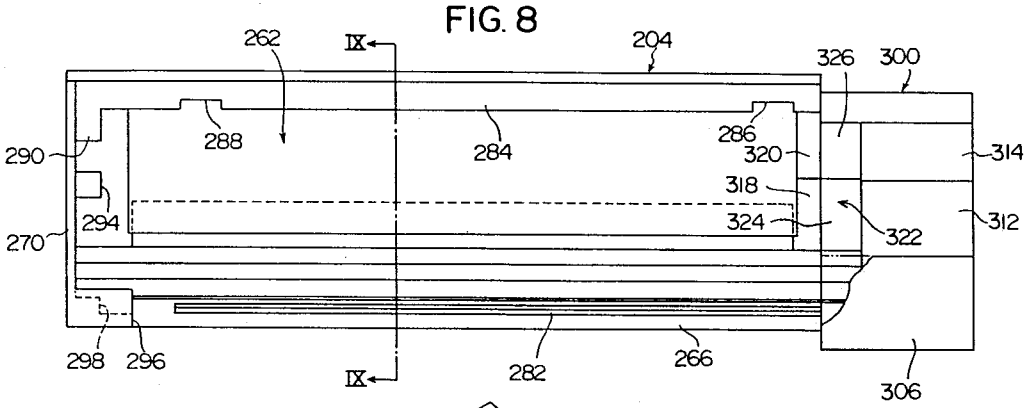
FIG. 8 is a side elevation showing a toner recovery box receiving space in the unit of FIG. 7.
Figure 9:
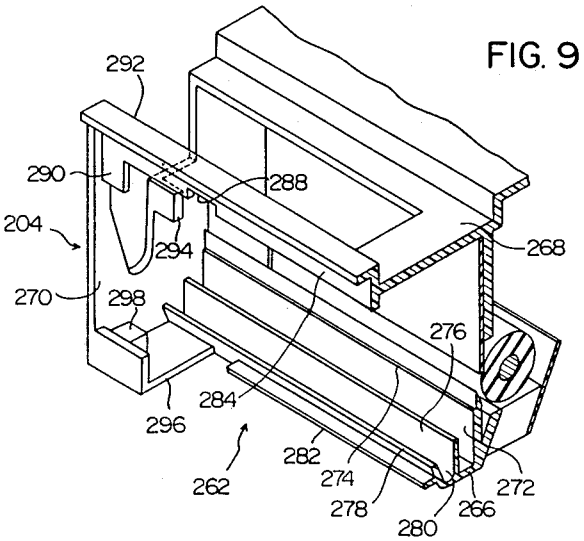
FIG. 9 is a partial perspective view showing the toner recovery box receiving space in the unit of FIG. 7 as it is viewed along the line IX—IX of FIG. 8.
Figure 10:
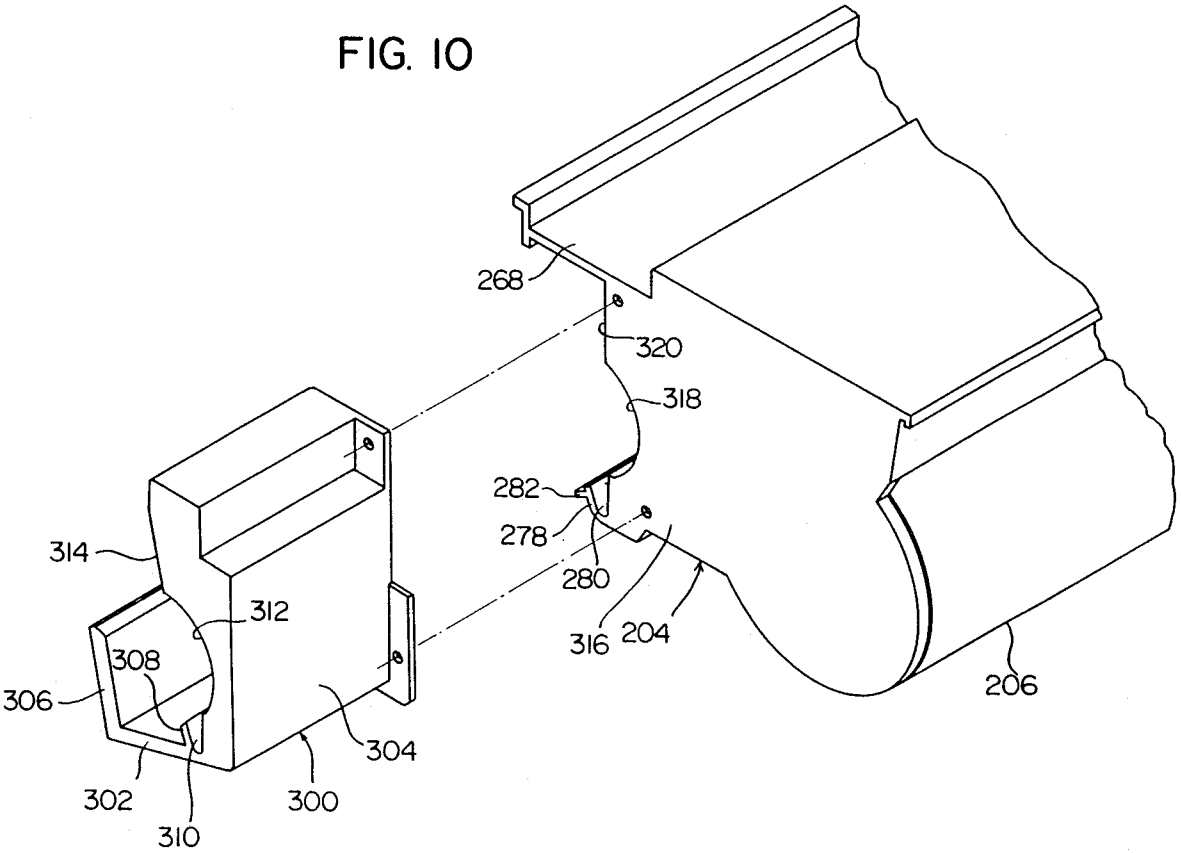
FIG. 10 is an exploded partial perspective view showing the front end portion of the toner recovery box receiving space in the unit of FIG. 7.

With reference to FIGS. 8 to 10, particularly FIG. 9, taken in conjunction with FIG. 7, the space 262 formed in the supporting structure 204 is opened entirely in its front surface, nearly entirely in its left side surface and the left half portion of its under surface. On the other hand, the supporting frame structure 204 has a bottom wall 266 extending substantially horizontally along the right half portion of the under surface of the space 262, an upper wall 268 extending substantially horizontally along the upper surface of the space 262, and a rear wall 270 extending substantially vertically from the rear end of the bottom wall 266 to the rear end of the upper wall 268. An upright guide wall 272, projecting upwardly a predetermined distance from the upper surface of the bottom wall 266 (a distance corresponding to about one-third of the total height of the space 262,) is formed integrally with the bottom wall 266. An abutting stepped portion 274, extending in the front-rear direction, is formed in one side surface (the left side in FIG. 7) of the upper portion of the guide wall 272, and furthermore, guide walls 276 and 278, projecting upwardly, are formed in the bottom wall 266 in spaced-apart relationship, and define a guide channel 280 extending in the front-rear direction. A lower part guiding longitudinal protrusion 282, projecting to the left in FIG. 7, is formed in the guide wall 278. It will be seen by referring to FIGS. 8 and 9 that the lower part guiding longitudinal protrusion 282 extends substantially horizontally in the rearward direction from its front end which is kept in alignment with the front end of the bottom wall 266, but does not extend to the rear wall 270, instead terminating at a point forward of the rear wall 270 by a predetermined distance. An upper part guiding longitudinal protrusion 284, extending substantially vertically from the left side edge, is formed in the upper wall 268. The upper part guiding protrusion 284 extends from its front end, which is kept in alignment with the front end of the upper wall 268, to the rear wall 270 and has rectangular notches 286 and 288 formed respectively at its front end portion and rear end portion. A projecting portion 290 extending downwardly is formed at the rear end of the upper part guiding longitudinal protrusion 284. As illustrated in FIG. 9, a continuously extending opening 292 is formed in the rear end portion of the upper wall 268 and the upper portion of the rear wall 270. Furthermore, as will be stated hereinafter, when the unit 202 is mounted in the housing of the image-forming machine, a toner detector 240, fixed to the under surface of the base plate 231 of the housing, projects into the space 262 through the opening 292. As shown in FIGS. 8 and 9, an actuating element 294 constructed of a forwardly extending projecting piece is formed in the front surface of the rear wall 270. Furthermore, in the lower end of the rear wall 270 is formed a forwardly extending L-shaped projecting wall portion 296, and a stopping block portion 298 is formed at a corner in the rear end of the projecting wall portion 296.

With reference to FIGS. 8 and 10, an additional member 300 is fixed to the front surface of the supporting frame structure 204 by a set screw (not shown), and the supporting frame structure 204 projects forwardly at its site where the space 262 exists. If desired, the additional member 300 may be formed integrally with the supporting frame structure 204. The additional member 300 has a bottom wall 302, a relatively high side wall 304 extending upwardly from one side edge of the bottom wall 302, and a relatively low side wall 306 extending upwardly from the other side edge of the bottom wall 302. A guide wall 308 is formed in the bottom wall 302, and the guide wall 308 and the lower portion of the side wall 304 define a guide channel 310 which extends in the front-rear direction in alignment with the guide channel 280. The inside surface of the side wall 304 has an arcuate portion 312 and a flat portion 314 extending upwardly from the arcuate portion 312. It will be seen by referring to FIG. 12-B in conjunction with FIG. 10 that the arcuate portion 312 and the flat portion 314 in the inside surface of the side wall 304 are of nearly the same shape as an arcuate portion 318 and a flat portion 320 formed in one side edge of the front wall 316 of the supporting frame 204, but are displaced counterclockwise in FIG. 12-B by a predetermined angle with respect to the arcuate portion 318 and the flat portion 320. It will be seen by referring to FIG. 8 that a dent portion 322 dented clockwise in FIG. 12-B is formed in the rear part of the inside surface of the side wall 304. The dent portion 322 has an arcuate portion 324 and a flat portion 326 which are in alignment with the arcuate portion 318 and the flat portion 320, or in other words, form the same plane as the arcuate portion 318 and the flat portion 320.

Figure 11:
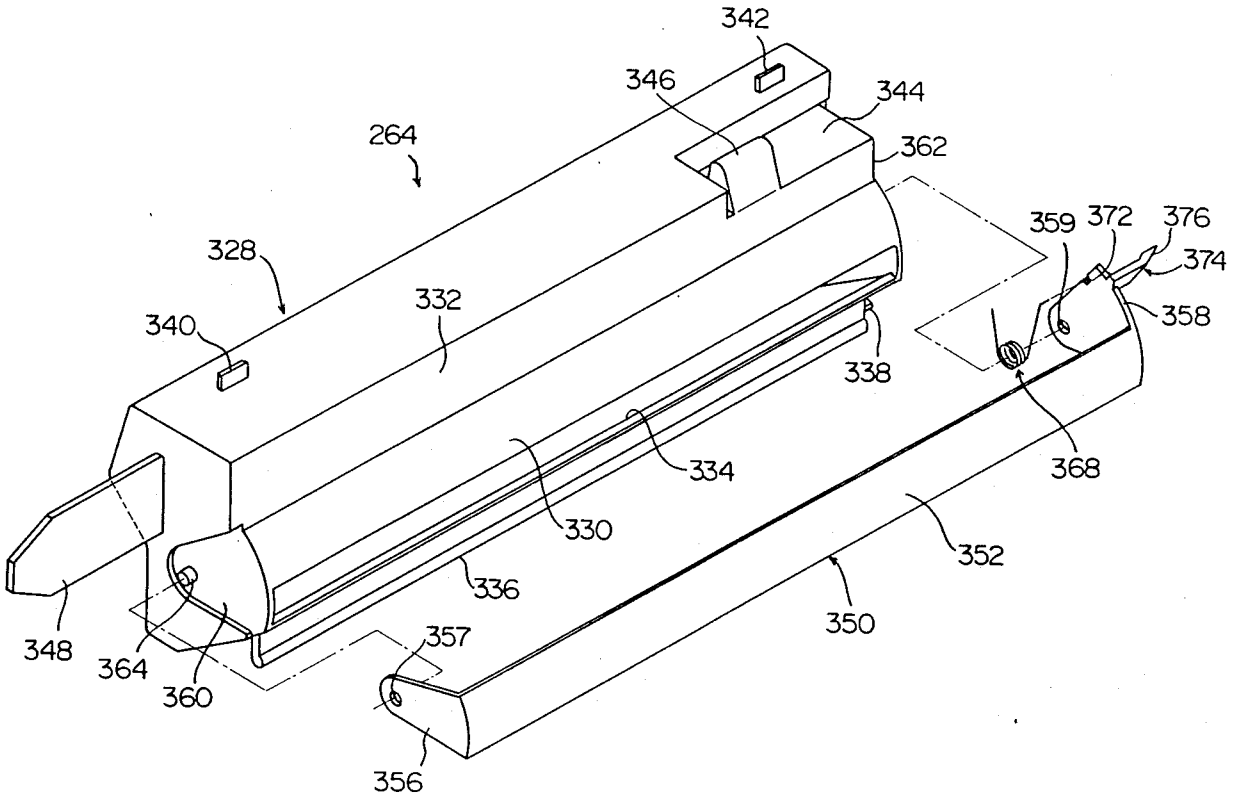
FIG. 11 is an exploded perspective view showing a toner recovery box in the unit of FIG. 7.

With reference to FIG. 11 together with FIG. 7, the toner recovery box, shown generally at 264, includes a box 328 preferably formed of transparent or semi-transparent synthetic resin. The box 328 is a hollow body extending in an elongate shape in the front-rear direction. One side surface, i.e. the right side surface in FIG. 7, has an arcuate portion 330 and a flat portion 332 extending upwardly from the arcuate portion 330. A toner inlet 334, preferably a rectangular opening extending in the front-rear direction over nearly the entire length of the box 328, is formed in the lower part of the arcuate portion 330. A downwardly extending guided protrusion 336 is formed in the under surface of the box 328. The lower end portion of the guided protrusion 336 extending in the front-rear direction has a nearly circular sectional shape. In the rear end portion of the under surface of the box 328 is formed a rectangular lower part guided protrusion 338 projecting to the right in FIG. 7. Upwardly projecting rectangular upper part guided protrusions 340 and 342 are formed at the front end portion and the rear end portion of the upper surface of the box 328. A nearly rectangular sedimentation portion 344 exists on one side of the rear end portion of the upper surface of the box 328, and a projecting portion 346 to be detected is formed in the sedimentation portion 344. A forwardly projecting gripping piece 348 is formed in the front surface of the box 328.

The toner recovery 264 further includes a cover member 350 having a main portion 352 arcuate in section and extending in the front-rear direction. As shown in FIG. 7, a long protrusion 354 extending inwardly is formed in the lower end edge of the main portion 352. Linking pieces 356 and 358, extending inwardly, are formed respectively at the front end and the rear end of the main portion 352. Holes 357 and 359 are respectively provided in the linking pieces 356 and 358. Depressed portions 360 and 362 corresponding to the linking pieces 356 and 358 are formed in the front surface and the rear surface of the box 328. A forwardly projecting short shaft 364 is provided in the depressed portion 360, and a rearwardly projecting short shaft 366 (FIG. 12-C) is provided in, the depressed portion 362. The cover member 350 is mounted on the box 328 by positioning the linking piece 356 at the depressed portion 360, and inserting the short shaft 364 into the hole 357, and also positioning the linking piece 358 at the depressed portion 362 and inserting the short shaft 366 (FIG. 12-C) into the hole 359. The cover member 350 so mounted on the box 328 is free to pivot between a closed position (the position shown in FIGS. 12-B and 12-C), in which the under surface of its long protrusion 354 (FIG. 7) abuts against the lower edge of the toner inlet 334 and an open position (the position shown in FIGS. 7, 13-B and 13-C) in which the upper surface of the long protrusion 354 (FIG. 7) abuts against the upper edge of the toner inlet 334, the pivoting being about an axis extending in the front-rear direction, i.e. the central axis of the short shafts 364 and 366, as a center. Elastic means 368, constructed of a helical sprng, is disposed between the box 328 and the cover member 350. It will be appreciated by referring to FIG. 12-C in conjunction with FIG. 11 that the helical spring constituting the elastic means 368 is idly fitted over the short shaft 366, and its one arm abuts against one side surface 370 of the depressed portion 362 while its other arm is positioned within a notch 372 formed in the linking piece 358. Thus, the elastic means 368 elastically biases the cover member 350 clockwise (counterclockwise in FIG. 12-C) as viewed from the front side of the cover member 350 and holds it elastically in the closed position. When the cover member 350 is held in the closed position, the toner inlet 334 of the box 328 is closed by the cover member 350. On the other hand, when the cover member 350 is held at the open position in the manner to be described, the toner inlet 334 of the box 328 is opened. A non-actuating element 374 made of a projecting piece extending rearwardly from the linking piece 358 is also formed in the cover member 350. An inclined surface 376 is formed in the front end portion of the non-actuating element 374.

The toner recovery box 264 described above is inserted into the toner recovery box receiving space 262 by the following procedure. With reference to FIGS. 12-A to 12-C in conjunction with FIGS. 8, 10 and 11, the first step is to move the tone recovery box 264 rearwardly from the front side of the additional member 300 and insert its rear portion into the additional member 300. At this time, the guided protrusion 336 formed in the box 328 is positioned in the guide channel 310 of the additional member 300, as shown in FIG. 12-B. Thus, the box 328, excepting its left upper portion in FIG. 12-B, is positioned in a space defined by the bottom wall 302 and the two side walls 304 and 306 of the additional member 300. As a result, as can be seen from FIG. 12-B the toner recovery box 364 is restrained at a first angular position shown in FIGS. 12-A, 12-B and 12-C by the side walls 304 and 306 of the additional member 300. Then, the toner recovery box 364 is further moved rearwardly to a particular position shown in FIG. 12-A. As a result, one side portion of the lower end of the rear surface of the box 328 (the left side portion of the lower end in FIG. 12-B) abuts against the projecting wall portion 296 (see FIG. 9 also) to thereby hamper further rearward movement of the toner recovery box 264. It will be appreciated by referring to FIGS. 12-B and 12-C that while the toner recovery box 264 is moved rearwardly to the particular position shown in FIG. 12-A, the guided protrusion 336 of the box 328 moves rearwardly in the guide channel 310 of the additional member 300 and the guide channel 280 formed in the supporting frame structure 204. The lower part guided protrusion 338 of the box 328 moves rearwardly along the under surface of the lower protruding protrusion 282 formed in the supporting frame structure 204.

When the toner recovery box 264 is inserted to the particular position shown in FIG. 12-A, the front end of the box 328 is positioned in correspondence to the dent portion 322 formed in the rear portion of the inside surface of the side wall 304 in the additional member 300. The lower part guided protrusion 338 of the box 328 is positioned beyond and rearwardly of the rear end of the lower part guiding protrusion 282 in the supporting frame structure 204. In addition, the upper part guided protrusions 340 and 342 of the box 328 are positioned in correspondence to the notches 286 and 288 formed in the upper part guiding protrusion 284 of the supporting frame structure 204. Consequently, the restraining of the toner recovery box 264 at the first angular position shown in FIGS. 12-B and 12-C is cancelled. Accordingly, when the toner recovery box 264 is turned clockwise in FIG. 12-B and counterclockwise in FIG. 12-C by holding the gripping piece 348 formed in the front surface of the box 328, it is turned to a second angular position shown in FIGS. 13-A to 13-C from the above first angular position shown in FIGS. 12-A to 12-C about the lower end portion of the guided protrusion 336 as a center. When the toner recovery box 264 is turned to the second angular position, the lower end portion of the arcuate portion 330 existing on one side surface of the box 328 abuts against the upper end portion of the upright guide wall 272 of the supporting frame structure 204, and thus the toner recovery box 264 is prevented from turning clockwise in FIG. 13-B and counterclockwise in FIG. 13-C beyond the second angular position, as shown in FIGS. 13-B and 13-C. It will be appreciated by referring to FIGS. 13-B and 13-C that the upper part guided protrusions 340 and 342 formed in the box 328 pass through the notches 286 and 288 formed in the upper part guiding protrusion 284 and are positioned on the right side in FIG. 13-B and left side in FIG. 13-C of the upper guiding protrusion 284. In addition, one side portion of the lower end of the rear surface of the box 328 is positioned above the projecting wall portion 296 to permit the toner recovery box 264 to move further rearwardly.

Then, the toner recovery box 264 held at the second angular position is further moved rearwardly to the final position shown in FIG. 13-A. As a result, one side portion of the lower end (the left side portion of the lower end in FIG. 13-B) in the rear surface of the box 328 abuts against the stopping block 298 (see FIG. 9 also) formed in the projecting wall portion 296, and one side portion of the upper end (the left side portion of the upper end in FIG. 13-B) of the box 328 abuts against the projecting portion 290 formed in the rear end of the upper part guiding protrusion 284. Consequently, further rearward movement of the toner recovery box 264 is hampered. When the toner recovery box 264 is moved from the above particular position (the position shown in FIG. 12-A) to the final position (the position shown in FIG. 13-A), the upper guided protrusions 340 and 342 of the box 328 move along the right side surface in FIG. 13-B of the upper guiding protrusion 284 and the left side surface in FIG. 13-C. As a result, the toner recovery box 264 is prevented from turning counterclockwise in FIG. 13-B and clockwise in FIG. 13-C and is restrained at the second angular position shown in FIGS. 13-A to 13-C. While the toner recovery box 264 is moved rearwardly from the particular position to the final position, the actuating element 294 provided on the supporting frame structure 204 exerts a "cam action" on the non-actuating element 374 provided in the cover member 350 to pivot the cover member 350 clockwise in FIGS. 12-C and 13-C against the elastic biasing action of the elastic means 368, as can be seen by comparing FIG. 12-C with FIG. 13-C. Thus, the cover member 350 is brought to the open position from the closed position, and as shown in FIG. 7, the toner inlet 334 of the box 328 is opened.

When the toner recovery box 264 is inserted and held at the final position as above, the detected protrusion 346 of the box 328 is positioned properly with respect to the toner detector 240 fixed to the under surface of the base plate 231 disposed within the housing of the image-forming machine. More specifically, the toner detector 240 has two downwardly extending portions 378 and 380 spaced from each other, and the detected projecting portion 346 of the box 328 is positioned between the two downwardly extending portions 378 and 380. A suitable light-emitting element (not shown) is disposed in one downwardly extending portion 378 and a suitable light receiving element (not shown) for receiving light from the light-emitting element is disposed in the other downwardly extending portion 380.

As operation of the image-forming machine on which the unit 202 is mounted is repeated, toner removed from the peripheral surface of the rotating drum 206 is carried into the box 328 through the open toner inlet 334 in the toner recovery box 264, as shown by arrow 260 in FIG. 7. When the box 328 is filled with toner, toner also exists in the projecting portion 346 of the box 328. As a result, light from the light emitting element (not shown) disposed in the downwardly extending portion 378 of the toner detector 240 is blocked by the toner, and the light-receiving element, disposed in the downwardly extending portion 280 of the toner detector 240, fails to receive light. On the basis of this phenomenon, the toner detector 240 produces a signal showing that the box 328 has been filled with toner. This signal energizes warning means (not shown) such as a warning lamp provided in the image-forming machine. As required, it renders the image-forming machine inoperable.

When the box 328 has been filled with toner, it is necessary to remove the toner recovery box 264 from the supporting structure 204 and to insert a fresh toner recovery box 264 into the space 262 of the supporting frame structure 204. The toner recovery box 264 may be removed from the supporting frame structure 204 by performing the above inserting operation in a reverse manner. Specifically, by holding the gripping piece 348 formed on the front surface of the box 328 the toner recovery box 264 can be moved forwardly from the final position shown in FIG. 13-A to the particular position shown in FIG. 12-A or a position just ahead of that (the position at which the front surface of the box 328 abuts against the front end surface of the dent portion 322 formed in the inside surface of the side wall 304 in the additional member 300 at which the forward movement of the toner recovery box 264 at the second angular position is hampered). As a result, as can be seen from a comparison of FIG. 13-C with FIG. 12-C, the non-actuating element 374 formed in the cover member 350 of the toner recovery box 264 is removed from the actuating element 294 provided in the supporting frame structure 204. Hence, the cover member 350 is brought by the elastic biasing action of the elastic means 368 to a position at which cover member 350 closes the toner inlet 334, and cover member 350 is elastically held at this closed position. It will be appreciated by referring to FIGS. 13-A and 12-A that where the toner recovery box 264 has been moved forwardly to the particular position or a position slightly ahead of that, the toner inlet 334 of the box 328 is surrounded by the supporting frame structure 204 itself and the forwardly extending portion provided by the additional member 300, and in this state, the cover member 350 is held at the closed position. Accordingly, in the early stage of the operation of removing the toner recovery box 264 from the supporting frame structure 204, or in other words before the toner inlet 334 is closed by the cover member 350, scattering of toner from the toner inlet 334 does not occur.

Then, the toner recovery box 264 is turned from the second angular position shown in FIGS. 13-A to 13-C to the first angular position shown in FIGS. 12-A to 12-C. Next, the toner recovery box 264 is further moved forwardly to box 264 from the supporting frame 204 and the additional member 300. Since in this removing operation, the toner inlet 334 is closed by the cover member 350, dropping or scattering of toner from the toner inlet 334 is prevented. The removed toner recovery box 264 can be directly discarded.

In the illustrated embodiment, the operation of inserting and withdrawing the toner recovery box 264 into and from the space 262 is carried out by mainly moving the toner recovery box 264 in the front-rear direction. If desired, the above embodiment may be modified so that the toner recovery box can be inserted and withdrawn into and from the toner recovery box receiving space by moving it in any other desired direction such as the vertical direction.

While the cleaning device constructed in accordance with this invention has been described with reference to the preferred embodiments shown in the attached drawings, it should be understood that the present invention is not limited to these specific embodiments, and various changes and modifications are possible without departing from the scope of the invention described and claimed herein.

For example, the present invention has been described with regard to the cleaning device provided in a unit including a rotating drum, the invention can also be applied to a cleaning device adapted to be mounted in the housing of the image-forming machine independently of the rotating drum.

What is claimed is:

1. A cleaning device for an image-forming machine, said cleaning device comprising:

a supporting frame structure including means defining a toner recovery box receiving space having an open front surface and extending in the front-rear direction of said support frame structure;

a toner recovery box having a toner inlet extending in the front-rear direction of said toner recovery box, said box being adapted to be inserted into said receiving space by being moved rearwardly relative to said supporting frame structure and to be withdrawn from said space by being moved forwardly relative to said supporting frame structure;

a receiving member provided on the front surface of said supporting frame structure and positioned in front of said receiving space;

a protective cover having a rear end portion adapted to be inserted in said receiving member and adapted for receiving said toner recovery box as said toner recovery box is withdrawn from said receiving space and for covering said toner inlet; and restraining means on said protective cover for inhibiting upward movement and rearward movement of said toner recovery box relative to said protective cover, and so inhibiting detachment of said toner recovery box from said protective cover once said toner recovery box has been received in said protective cover.

2. The cleaning device of claim 1 wherein said toner inlet is formed in the bottom surface of said toner recovery box, and said protective cover has a bottom wall covering said bottom surface of said toner recovery box.

3. The cleaning device of claim 2 wherein:

said toner recovery box has in at least one of the side surfaces thereof a shoulder portion extending in the front-rear direction of said toner recovery box and directed upwardly;

said protective cover has two side walls extending upwardly from said bottom wall, and a front wall extending upwardly from the front end of said bottom wall; and said restraining means comprises a longitudinal protrusion projecting inwardly from at least one of said side walls of said protective cover and an anchoring piece disposed at said rear end portion of said protective cover, said longitudinal protrusion adapted to act on said shoulder portion of said toner recovery box and to inhibit upward movement of said toner recovery box, and said anchoring piece permitting receiving of said toner recovery box in said protective cover by elastic deformation of at least one of said protective cover and said toner recovery box, but upon receiving of said toner recovery box in said protective cover, acting on the rear surface of said toner recovery box to inhibit rearward movement of said toner recovery box.

4. The cleaning device of claim 3 wherein said anchoring piece is attached to said longitudinal protrusion and is of a wedge shape such that the amount of its inward projection from said longitudinal protrusion increases progressively in the forward direction of said protective cover.

5. The cleaning device of claim 3 wherein said receiving member has a bottom wall and two side walls adapted to surround said bottom wall and said two side walls of said protective cover when said protective cover rear end portion is inserted in said receiving member; said receiving member further having a protrusion projecting inwardly from at least one of said two side walls of said receiving member to inhibit upward movement of said protective cover.

6. A cleaning device for an image-forming machine, said cleaning device comprising:

a supporting frame structure including guide means and means defining a toner recovery box receiving space having at least the front surface thereof open, said receiving space extending in the front-rear direction of said supporting frame structure;

a toner recovery box adapted to be withdrawably inserted into said receiving space by being moved rearwardly relative to said supporting frame structure from a withdrawn position, through an intermediate, particular position to a final position and to be withdrawn from said receiving space by being moved forwardly relative to said supporting frame structure, said recovery box having a toner inlet extending in the front-rear direction of said recovery box, a cover member mounted on said recovery box and adapted to move between a closed position at which said cover member closes said toner inlet and an open position at which said cover member exposes said toner inlet, and elastic means for elastically biasing said cover member to the closed position;

an actuating element formed on said frame structure;

a non-actuating element formed on said cover member and, upon rearward movement of said toner recovery box from said intermediate position toward said final position in said receiving space, cooperating with said actuating element to move said cover member to the open position thereof against the biasing force of said elastic means, said actuating element and said non-actuating element not so cooperating during forward movement of said toner recovery box toward said intermediate position; and guided means formed on said recovery box and cooperating with said guide means (a) to restrain said toner recovery box at a first angular position while said toner recovery box is being moved rearwardly to said particular position and forwardly from said particular position, (b) to inhibit rearward movement of said toner recovery box beyond said particular position when said toner recovery box is at said first angular position, (c) to permit said toner recovery box to pivot to a second angular position when said toner recovery box is at said particular position, (d) to permit the toner recovery box to move rearwardly beyond the particular position to the final position when the toner recovery box is at said second angular position, and (e) to restrain the toner recovery box at the second angular position while the toner recovery box is between said particular position and said final position.

7. The cleaning device of claim 6 wherein when said toner recovery box is at said particular position, said toner inlet of said toner recovery box is surrounded along the entire length thereof by said supporting frame structure.

8. The cleaning device of claim 6 wherein said cover member of said toner recovery box is free to pivot between the closed position and the open position about an axis extending in the front-rear direction of said toner recovery box.

* * * * *